United States Patent [19]

Wilkerson

[11] Patent Number: 4,553,689

[45] Date of Patent: Nov. 19, 1985

[54] STAPLE THROAT FOR STAPLING MACHINE

[76] Inventor: James W. Wilkerson, Highway 64 East, Savannah, Tenn. 38372

[21] Appl. No.: 437,346

[22] Filed: Oct. 28, 1982

[51] Int. Cl.[4] ..... B25C 5/02

[52] U.S. Cl. ..... 227/139; 227/156; 227/120; 227/116

[58] Field of Search ..... 227/120, 155, 114, 115, 227/116, 121, 130, 131, 139

[56] References Cited

U.S. PATENT DOCUMENTS

| | | | |
|---|---|---|---|
| 2,058,034 | 10/1936 | Prochiette | 227/139 |
| 2,727,235 | 12/1955 | Cameron | 227/139 |
| 2,953,787 | 9/1960 | Ollig et al. | 227/139 X |
| 4,380,312 | 4/1983 | Landrus | 227/116 |

*Primary Examiner*—Paul A. Bell

*Attorney, Agent, or Firm*—Harrington A. Lackey

[57] ABSTRACT

A staple throat for a stapling machine comprising a one-piece body member having a central longitudinal bore therethrough, and diametrically opposed elongated guide slots in the sides of the bore for receiving and guiding staples and a flat staple driver toward an anvil in the stapling machine.

9 Claims, 5 Drawing Figures

STAPLE THROAT FOR STAPLING MACHINE

BACKGROUND OF THE INVENTION

This invention relates to stapling machines, and more particularly to a staple throat for a stapling machine.

Heretofore in the art of stapling machines, and more particularly a stapling machine for stapling steel supports on shoe insoles, the staple throats are constructed of two longitudinal body pieces bolted together. The two body pieces include a pair of opposed elongated flat channels, which, when assembled, form an elongated slot for receiving the staples and the flat-bladed staple driver. The staple slot has a rectangular cross section and is barely larger in cross section than the staples and the staple driver. Accordingly, there is substantial frictional engagement between the walls of the staple guide slot and the staples and the staple driver. Furthermore, the narrowness of the slots affords opportunities for the staples to become jammed within the slot to halt the stapling operation until the slot can be cleared.

Furthermore, a two-piece staple throat, bolted together, is relatively expensive to manufacture and is less durable, because of the separate pieces for the body member and the tendencies of the bolts connecting the two pieces to become loose.

SUMMARY OF THE INVENTION

It is therefore an object of this invention to overcome the above-enumerated disadvantages by providing a staple throat which is easier and less expensive to manufacture and which is more durable.

The staple throat made in accordance with this invention is formed from a one-piece body member including an elongated central bore, into the diametrically opposite sides of which are formed a pair of opposed longitudinal guide slots for receiving the staples and the flat-bladed staple driver. In this construction, only the opposed guide slots have any frictional contact with either the staples or the staple driver. The central bore has a diameter which is substantially greater than the breadth of the slots, and therefore the walls of the bore do not come in frictional contact with either the staples or the staple driver. Moreover, the relatively large cross-sectional area of the bore permits staples which are jammed to be easily removed by inserting a tool or other instrument longitudinally through the bore to force the staples from the staple throat.

The staple throat made in accordance with this invention may be easily constructed by turning the outside of the body member to have two cylindrical sections of different diameters, and turning the interior central bore. The outer cylindrical section of smaller diameter is designed to be received in a corresponding cylindrical recess in the machine frame for holding the staple throat in a stationary stapling position. The slots may be broached in the side walls of the central bore.

The staple throat is also characterized by straddle ledges at the opposite end of the staple throat for straddling the piece to be stapled, with one side of the ledges open to permit the discharged staples clenched into the workpiece to move in one longitudinal direction away from the staple throat, after the stapling operation.

DESCRIPTION OF THE PREFERRED EMBODIMENTS

Figure 1:
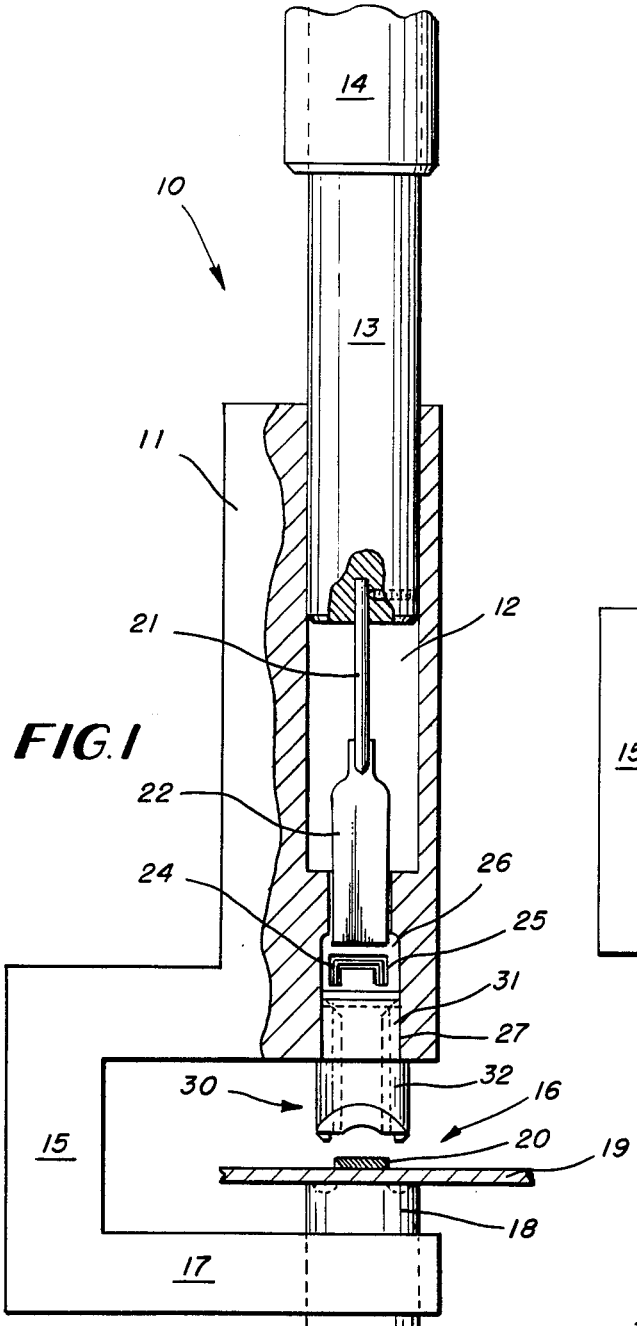
FIG. 1 is a fragmentary, front elevational view of a stapling machine incorporating the staple throat made in accordance with this invention, in an inoperative, non-stapling position.
Figure 2:
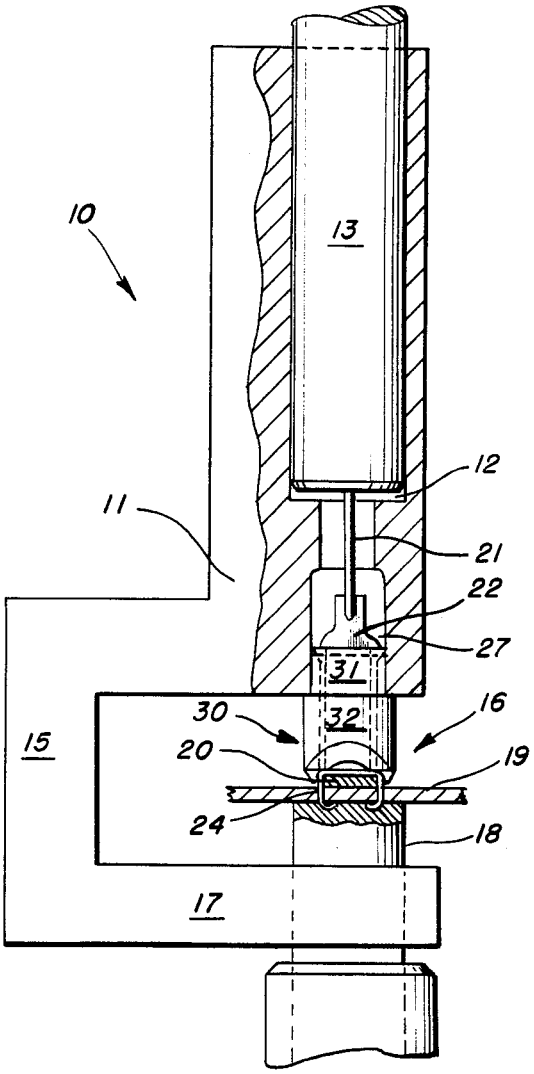
FIG. 2 is a fragmentary sectional view similar to FIG. 1, with the staple driver and anvil in an operative stapling position.

Referring now to the drawings in more detail, FIGS. 1 and 2 disclose a portion of a conventional shoe stapling machine 10, such as a United Shoe Machinery Company shank stapler machine. The shoe stapler machine 10 includes a stationary frame 11 having an upper cylindrical cavity 12 for receiving a ram piston 13 adapted to be reciprocally moved by hydraulic fluid within the ram cylinder 14.

The lower portion 15 of the frame 11 is bow-shaped, or U-shaped, to provide space for the stapling operation at a stapling station 16.

Vertically reciprocally received in the lower horizontal leg portion 17 of the frame piece 15 is a conventional anvil 18, which is adapted to be reciprocally moved between its lower inoperative position, disclosed in FIG. 1, and its upper operative stapling position, disclosed in FIG. 2. The vertical reciprocal movement of the anvil 18 may be effected by a foot pedal, not shown, in a conventional mode of operation.

The top face of the anvil 18 is adapted to receive the workpiece upon which the stapling operation is effected. As disclosed in FIGS. 1 and 2, the anvil is supporting the insole of a shoe, the shank portion 19 of which is shown fragmentarily in FIGS. 1 and 2. Resting on top of the upside-down shank portion 19 is the steel arch support or bar 20.

Depending from the bottom of the ram piston 13 is an elongated connecting rod 21, to the bottom end of which is connected an elongated flat staple driver 22, of known construction.

As disclosed in FIG. 1, U-shaped staples 24 are fed by means, not shown, from the other side of the frame 11 through a correspondingly U-shaped feed slot 25, to position one staple 24 at a time in the vertical path of the staple driver 22, within the feed chamber 26.

The parts thus far described are well known in the art of shoe stapling machines.

Firmly seated and secured within the cylindrical throat cavity 27 of the frame 11 is the staple throat 30 made in accordance with this invention. The throat cavity 27 may be a continuation of the cylindrical feed chamber 26 extending downward and opening through the bottom portion of the frame 11.

The staple throat 30 is a one-piece body member of steel stock, the exterior of which is turned twice. The upper cylindrical section or portion 31 of the staple throat body member 30 is turned to a diameter substantially equal to the inner diameter of the throat cavity 27, so that the upper section 31 will be securely seated within the throat cavity 27. The upper section 31 may be secured in position within the throat cavity 27 by means, not shown, such as a set screw, in order to hold the staple throat 30 in a stationary position within the bottom end portion of the frame 11.

The lower cylindrical section 32 of the staple throat body member 30 is turned to a diameter larger than the upper section 31 to limit the upward movement of the staple throat 30 within the throat cavity 27, and to permit the lower section 32 to project downward into the stapling station 16.

A central bore 34 is formed, preferably by turning, coaxially and longitudinally through the cylindrical body member of the staple throat 30 and opens through the top portion of the section 31 and through the bottom portion of the section 32. Formed along diametrically opposite sides of the wall of the central bore 34 are a pair of straight, longitudinally extending, guide slots 35, which may be formed by broaching. The guide slots 35 extend continuously through the length of the staple throat body member 30 and open through the bottom and top ends of the body member and in vertical alignment with a staple throat 24 in the feed chamber 26, in feeding position, and also in vertical alignment with the staple driver 22. The plane of the flat blade of the staple driver 22 is coplanar with the central plane of both guide slots 35. Thus, the guide slots 35 are aligned with the staple 24 and the staple driver 22, so that when the staple driver 22 is forced downward by the ram piston 13, the driver 22 carries or pushes a staple 24 in the feeding position downward through the central bore 34 of the staple throat 30 in such a manner that the opposite ends of the staple 24 travel or pass within the corresponding opposed guide slots 35.

The diameter of the central bore 34 is slightly less than the width of a staple 24. The combined depths, that is, the transverse dimension coplanar with both guide slots, of the slots 35 and the diameter of the central bore 34 are slightly greater than the width of the staple 24. Moreover, the breadth or thickness of each guide slot 35, that is, the dimension normal to the plane of both guide slots 35, is slightly greater than the thickness of the staple 24. Thus, sufficient clearance is provided within the guide slots 35 for the staple 24 to easily move downward through the staple throat 30.

The dimensions of the guide slots 35, particularly their breath and depth, are also sufficient to provide adequate clearance for the width and thickness of the flat blade of the staple driver 22.

Since the central bore 34 is preferably cylindrical and has a diameter substantially greater than the breadth of the slots 35, there is more than ample clearance for each staple 24 to move the entire length or depth of the staple throat 30 without any interference from the bore 34.

Furthermore, if a staple 24 becomes misaligned with the slots 35 within the staple throat 30, and becomes jammed within the slots 35, to block the movement of the staple driver 22, there is more ample clearance provided by the central bore 34 to insert a tool through either end of the bore 34 in order to disengage or remove the jammed staple 24 from the staple throat 30.

Furthermore, because of the substantial clearance provided by the central bore 34 and also because of the minimum contact between each staple 24 and only the slots 35, jamming is reduced to a minimum. Moreover, ordinary wear between the staple 24 and the slots 35, as well as between the staple driver 22 and the slots 35 is minimal.

The upper ends of both slots 35 diverge in both cross sectional dimensions to form tapered guideways 36. The tapered guideways 36 facilitate entry of the respective staples 24 into the guide slots 35 as the staples 24 move downwardly under the force of the driver 22. Thus, if a staple 24 is canted, skewed, or is out of its normal alignment with the slots 35, the tapered guideways 36 will guide the pointed ends or prongs of the staple, to cause the staple 24 to right itself or assume its normal feeding attitude in the central vertical plane of the slots 35, by the time the staple 34 enters the slots 35.

Figure 3:
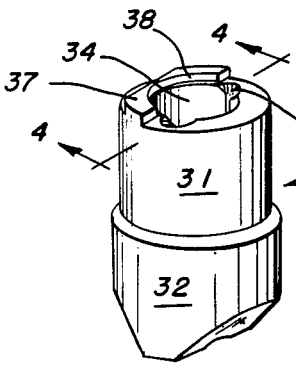
FIG. 3 is a top perspective view of the staple throat made in accordance with this invention.
Figure 4:
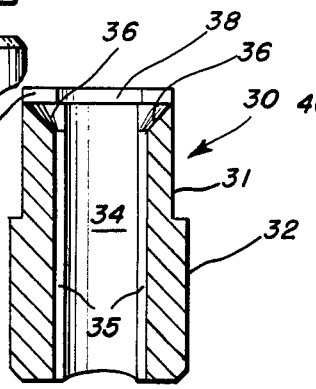
FIG. 4 is a section taken along the line 4—4 of FIG. 3.

The upper face of the staple throat 30 may be provided with an off-center transverse locator bar 37, to engage a cooperating bar or piece, not shown, within the throat cavity 27 in order to locate the stale throat 30 against rotation within the frame 11 in its proper attitude. The transverse locator bar 37 is relieved to form a semi-circular recess, which is in effect, a continuation of the cylindrical surface of the central bore 34, as best shown in FIG. 3.

Figure 5:
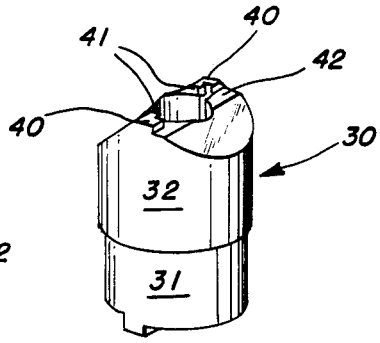
FIG. 5 is a bottom perspective view of the staple throat made in accordance with this invention.

The bottom face of the staple throat 30 is provided with L-shaped ledges 40 diametrically opposed to each other on opposite sides of the central bore 34, with their innermost opposed edges 41 being spaced apart a distance slightly greater than the workpiece, namely the steel support bar 20. The L-shaped cross section of each of the ledges 40 is configured to form a lower extension of the end wall and one side wall of each of the guide slots 35. The opposite sides of the ledges 40 are relieved, so that there will be no extension of that side of the guide slot 35, to provide a clearance for the top of the staple 24, after the staple 24 has been driven into the insole piece 19 and clenched by the anvil 18. Thus, the staple workpiece may then be easily removed in the direction in which the relieved edge or side of the ledges 40 are open. When the staple workpiece is removed from the stapling station 16, the support bar 20 and the top of the staple 24 may be moved away from the L-shaped ledges over the face 42 (FIG. 5) of the staple throat 30.

The operation of the stapler machine 10, including the staple throat 30, made in accordance with this invention, is essentially the same as any conventional shoe stapling machine.

With the ram piston 13 in its upper position disclosed in FIG. 1, with the staple driver 22 raised above the staple feed slot 25, and the anvil 18 in its lowered position, the workpiece, such as the insole 19 and support bar 20, are placed in their stapling positions, on top of the anvil 18, in the proper attitude for stapling.

The operator then actuates a mechanism (not shown), for first elevating the anvil 18 from the position disclosed in FIG. 1 to the position disclosed in FIG. 2, and immediately thereafter the ram cylinder 14 is actuated to drive the piston 13 and driver 22 downward, carrying a single staple 24 downward through the staple throat 30, to drive the staple 24 across the support bar 20 and downward through the insole 19 until the points of the staple 24 are clenched, as illustrated in FIG. 2. The anvil 18 is then lowered, and the workpiece 19, with the clenched support bar 20, is removed in the direction of the open side of the L-shaped ledges 40, and the next workpiece and support bar are placed in position for the next stapling operation.

As previously described, not only is the staple throat 30, made in accordance with this invention, more easily manufactured at less expense, but the staple throat 30 has a greater operating life with less wear and maintenance than staple throats currently used in shoe stapling machines.

It will be readily apparent that the staple throat 30 may be used in connection with other types of stapling machines.

What is claimed is:

1. In a stapling apparatus including a frame, having a stapling station, an anvil in the stapling station for receiving a workpiece, an elongated flat staple driver, and means for reciprocally moving the staple driver toward and away from the anvil in the stapling station, a staple throat comprising:

(a) an elongated body member having an operative end portion and an opposite entry end portion, (b) a longitudinal straight bore extending longitudinally through said elongated body member and opening through both said end portions, (c) a pair of elongated opposed, parallel, coplanar guide slots in opposite sides of said bore extending the length of said bore and opening through both said end portions, (d) the depth of said guide slots permitting the reception and passage of a staple of predetermined size longitudinally through said slots, (e) the breadth of said guide slots being substantially less than the corresponding dimension of said bore normal to the plane of said guide slots, (f) means fitting said body member in the frame of the stapling apparatus in the stapling station with said operative end portion opposing the anvil, said bore being in longitudinal alignment with the staple driver, and said slots receiving the opposite edges of the staple driver as the staple driver reciprocates through said bore, so that said body member, the staple driver and the anvil cooperate to drive a staple from the position between said guide slots to an operative position engaging the workpiece on the anvil.

2. The invention according to claim 1 in which said guide slots terminate in diverging flared portions in said entry end portion.

3. The invention according to claim 1 in which said bore is cylindrical.

4. The invention according to claim 3 in which said body member comprises a first cylindrical portion adjacent said entry end portion. and a second cylindrical portion adjacent said operative end portion, but of a diameter greater than said first cylindrical portion, cylindrical cavity means in said frame for receiving said first cylindrical portion.

5. The invention according to claim 4 in which said body member is of one-piece material.

6. The invention according to claim 1 in which said guide slots terminate in said operative end portion in diametrically opposed ledges relieved along one of the sides of the ledges, so that said guide slots are open through said one sides.

7. The invention according to claim 6 in which said ledges comprise L-shaped longitudinal surfaces which are extensions of the other sides and the extremities of said guide slots.

8. The invention according to claim 6 in which said ledges are spaced apart a distance adapted to receive the workpiece in said operative position.

9. The invention according to claim 1 in which only the edges of the staple driver are in frictional contact only with the guide slots during the reciprocal movement of the staple driver through the bore.

* * * * *